US007041339B2

(12) United States Patent
Kanke et al.

(10) Patent No.: US 7,041,339 B2
(45) Date of Patent: May 9, 2006

(54) COATING DEVICE AND COATING METHOD USING THE DEVICE

(75) Inventors: Shin Kanke, Shizuoka-ken (JP); Hiromu Ando, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/437,973

(22) Filed: May 15, 2003

(65) Prior Publication Data

US 2003/0217692 A1 Nov. 27, 2003

(30) Foreign Application Priority Data

May 22, 2002 (JP) ..... 2002-147940

(51) Int. Cl.
*B05D 7/00* (2006.01)

(52) U.S. Cl. ..... 427/428.01; 427/434.3; 118/223; 118/414

(58) Field of Classification Search ..... 118/414, 118/419, 413, 106, 117–119, 121, 122, 223, 118/206, 217, 216, 255, 258, 405; 427/428, 427/434.3, 434.4, 359, 428.01, 428.18, 428.19, 427/428.2

See application file for complete search history.

(56) References Cited

U.S. PATENT DOCUMENTS

| | | | | |
|---|---|---|---|---|
| 4,116,162 | A | 9/1978 | Dinter et al. | |
| 4,263,870 | A | 4/1981 | Saito et al. | |
| 4,518,637 | A | 5/1985 | Takeda et al. | |
| 4,521,459 | A | 6/1985 | Takeda | |
| 5,083,527 | A | 1/1992 | Naruse | |
| 5,858,090 | A * | 1/1999 | Gottwald | 118/413 |
| 6,579,368 | B1 * | 6/2003 | Kohl et al. | 118/414 |
| 2002/0076499 | A1 | 6/2002 | Kanke et al. | |
| 2003/0049379 | A1 | 3/2003 | Kanke et al. | |

FOREIGN PATENT DOCUMENTS

| | | |
|---|---|---|
| GB | 1192515 | 5/1970 |
| JP | 58-004589 | 1/1983 |
| JP | 6-7816 | 3/1994 |
| JP | 2002-192050 | 7/2002 |
| JP | 2002-224608 | 8/2002 |
| JP | 2003-053245 | 2/2003 |
| JP | 2003-103212 | 4/2003 |

OTHER PUBLICATIONS

EP Search Report for EP 03 01 1545 mailed Sep. 30, 2003.

* cited by examiner

*Primary Examiner*—Brenda A. Lamb
(74) *Attorney, Agent, or Firm*—Sughrue Mion, PLLC

(57) ABSTRACT

A coating device is disclosed which is provided with a first side bar, which extends along a transverse direction of a conveyance plane, which is a conveyance path of a belt body, and a second side bar, which is located at a downstream side of the first side bar. Also provided are a channel, which supplies a liquid at an upstream side of the first side bar, and a liquid-pooling section, which accumulates the liquid during coating of the liquid and is located between the first side bar and the second side bar. Also disclosed is a method which uses this coating device to coat a liquid on a belt body which is conveyed at high speed.

19 Claims, 5 Drawing Sheets

COATING DEVICE AND COATING METHOD USING THE DEVICE

BACKGROUND OF THE INVENTION

1. Technical Field

The present invention relates to a coating device and a coating method. More particularly, the present invention relates to a coating device and coating method in which, in a case in which a belt body is conveyed at high speed while a coating fluid with high viscosity is coated, liquid interruption due to entrained air that is carried in with the belt body does not occur.

2. Description of the Related Art

A planographic printing plate undergoes processes as follows to be fabricated. Commonly, at least one face of an aluminium web formed of pure aluminium or an aluminium alloy is dressed. Then an electrolytic oxidation layer is formed at that face as necessary, and thus a support web is formed. Next, a platemaking layer-forming liquid, such as a photosensitive layer formation solution, or a heat-sensitive layer formation solution, is coated onto a surface at the side of the support that has been dressed and is dried, and a photosensitive or heat-sensitive platemaking layer surface is formed.

Generally, a bar coater is employed for coating a coating liquid, such as a photosensitive layer formation solution, or a heat-sensitive layer formation solution, at a belt body, such as the aforementioned support web.

Conventionally, this bar coater is generally equipped with a bar and a coating section. While the bar is in contact with a lower surface of a continually running web, the bar rotates in a direction the same as the running direction of the web, or a direction opposite thereto. While the web is running, the coating section discharges the coating liquid at an upstream side from the bar, relative to the running direction of the web, and forms a coating liquid pool, thus coating the coating liquid onto the lower face of the web. The upstream side relative to the running direction of a web is hereafter referred to simply as "the upstream side".

The bar coater may be an SLB-type bar coater or a PBS-type bar coater. An SLB-type bar coater disclosed in Utility Model Registration No. 2,054,836 includes a dam plate which is provided in proximity with a bar at the upstream side of the bar, and is formed such that thickness at an upper end portion thereof becomes thin toward a downstream side in the running direction of the web. The upper end portion of the dam plate curves toward the bar, and includes a flat face with a length of 0.1 to 1 mm at a peak portion thereof. A PBS-type bar coater disclosed in Japanese Patent Application Publication (JP-B) No. 58-004589 includes a first dam plate which is formed such that thickness at an upper end portion thereof becomes thinner toward a downstream side. This bar coater is also provided with a second dam plate at the downstream side of the bar. The downstream side in the running direction of a web is hereafter referred to simply as "the downstream side".

However, when the running speed of the support web becomes higher, an entrained air layer, which is a film of air that follows along and runs with the support web, that is, entrained air, is formed at the surface of the support web.

In either of the above-described SLB-type bar coater and PBS-type bar coater, when an entrained air layer is formed at the surface of the support web, the entrained air layer is carried into the coating liquid pool. As a result, the coating liquid is not applied to the surface of the support web uniformly, and coating of the coating liquid is not carried out stably, causing film discontinuities.

SUMMARY OF THE INVENTION

An object of the present invention is to provide a coating device and coating method which can carry out stable coating such that film discontinuities do not occur at a coating film, even in a case in which coating is carried out while a belt body such as a support web is run at a high speed which is high enough that an entrained air layer is formed at a surface of the belt body.

A first aspect of the present invention is a coating device which coats a coating liquid on a surface of a belt body which is conveyed in a certain direction. This coating device includes a first side bar, a second side bar, a coating liquid supply channel, and a liquid-pooling section. The first side bar extends along a transverse direction of a conveyance plane, which includes a conveyance path of the belt body. The second side bar extends in parallel with the first side bar at a downstream side relative to the first side bar. The coating liquid supply channel supplies the coating liquid at the upstream side of the first side bar. The liquid-pooling section is located between the first side bar and the second side bar, and accumulates the coating liquid at a time of coating of the coating liquid.

In the coating device described above, the coating liquid supplied from the first side coating liquid supply channel is drawn up by the first side bar. Here, a portion of the coating liquid adheres to the surface of the belt body, and the rest passes through between the belt body and the first side bar and is accumulated in the inter-bar liquid-pooling section.

The coating liquid that has adhered to the surface of the belt body is regulated to a predetermined coating amount at the second side bar. That is, where the coating liquid is excessively applied at the first side bar, the coating liquid is scraped off from the coated surface at the second side bar, and where a coating amount of the coating liquid at the first side bar is insufficient, the coating liquid at the coated surface is supplemented at the second side bar. Herein, the coated surface is a face of the belt body that is coated with the coating liquid.

Therefore, even in a case in which the coating liquid is not applied uniformly at the first side bar, the coating amount of the coating liquid is maintained to be constant at the second side bar. As a result, a uniform coated surface is obtained.

Entrained air, which is entrained at the belt body and guided in from the upstream side of the coating device, is pushed back in the upstream direction by pressure of the coating liquid that has accumulated at the inter-bar liquid-pooling section. In other words, the entrained air is blocked. As a result, even in cases in which the conveyance speed of the belt body is raised, liquid interruption due to the entrained air will not occur, and a uniformly coated surface is obtained.

The first side bar and the second side bar may be smooth bars with surfaces which are even. The bars may also be, for example, grooved bars in which circumferential direction grooves are formed, wire bars at whose surfaces metallic wires with diameters of around 0.1 mm are wound to a predetermined pitch or are tightly wound.

Belt bodies have continuous belt forms and include base materials having flexibility. Specific examples include, besides a support web mentioned above, base materials which are employed in photosensitive materials, magnetic recording materials. A base material may be, for example, the aforementioned support web, a base material for a photographic film, baryta paper for photographic printing paper, a base material for an audio recording tape, a base material for a video tape, or a base material for a floppy disk. Alternatively, metallic thin plates employed for coated metallic plates, such as a color steel sheet, can be used.

Besides a platemaking layer-forming liquid mentioned in the "Description of the Related Art", the coating liquid may be a photosensitive agent colloid solution employed for forming a photosensitive layer for silver salt photography, a magnetic layer formation solution employed in formation of a magnetic layer of the above-mentioned magnetic recording material, various coating materials employed for undercoat layers, intermediate coating layers, and overcoat layers of the above-mentioned coated metallic plates.

The present invention may further include an air-liquid boundary surface formation apparatus which forms an air-liquid boundary surface, which includes a boundary surface between the coating liquid and air, between the belt body and the inter-bar liquid-pooling section.

In the coating device described above, because the air-liquid boundary surface is formed at the inter-bar liquid-pooling section, a stable coating liquid bead is formed at the upstream side of the second side bar. Therefore, even in a case in which the belt body is conveyed at high speed and a liquid with high viscosity is used as the coating liquid, coating of the coating liquid is carried out stably. Consequently, the occurrence of stripe-form defects, such as blanking lines which occur as a result of the coating liquid not being adhered sufficiently, constant pitch lines which are generated with a constant narrow pitch at the face of the belt body, black unevenness which is caused by the coating liquid being excessively adhered due to the coating liquid surface between the first side bar and the second side bar being raised up, can be more effectively prevented. These stripe-form defects are ripple lines, which are wave-like non-uniform portions that are manifested in the transverse direction of the belt body, stripe-form defects which are similarly manifested in the transverse direction of the belt body.

The air-liquid boundary surface formation apparatus may be, for example, a coating liquid surface-lowering mechanism which generates the air-liquid boundary surface by lowering a liquid surface of the coating liquid in the inter-bar liquid-pooling section.

The coating liquid surface-lowering mechanism may be, for example, a coating liquid lead-out channel, which leads out the coating liquid to outside the inter-bar liquid-pooling section.

In the present invention, the coating device may further include a second side coating liquid supply channel which supplies the coating liquid at a downstream side at the second side bar. Furthermore, in the present invention, a supplied amount of the coating liquid at the second side coating liquid supply channel may be controlled independently from a supplied amount of the coating liquid at the first side coating liquid supply channel.

In the coating device described above, even if supplied amounts of the coating liquid at the first side supply channel vary, supplied amounts of coating liquid at the second side supply channel are stably maintained. Consequently, a bead that is formed at a periphery of the second side bar is stably maintained in spite of variations in supplied amounts of the coating liquid at the first side coating liquid supply channel. Thus, instability of the bead, which causes defects at the coated surface, can be effectively prevented.

In the present invention, the air-liquid boundary surface formation apparatus may include a connecting channel which connects the inter-bar liquid-pooling section with the first side coating liquid supply channel.

One end of this communicating channel opens at the inter-bar liquid-pooling section, and the other end of the same opens at the first side coating liquid supply channel. In the first side coating liquid supply channel, the coating liquid flows at high speed toward the first side bar. Consequently, the coating liquid in the communicating channel is sucked out into the first side coating liquid supply channel from the other end side opening, and thus the coating liquid in the inter-bar liquid-pooling section is sucked into the communicating channel from the one end side opening. In this manner, the communicating channel functions as the coating liquid lead-out channel mentioned above, and thus the communicating channel encompasses the coating liquid surface-lowering mechanism.

In this coating device, an effect of sucking out by flowing the coating liquid in the first side coating liquid supply channel is utilized for forming the air-liquid boundary surface in the coating liquid pool. Thus, this structure, as well as being simple, operates reliably.

In the present invention, the connecting channel may include a coating liquid suction opening portion which opens along the transverse direction of the inter-bar liquid-pooling section, across substantially the whole width of the inter-bar liquid-pooling section.

In the coating device described above, a liquid surface height of the coating liquid is a uniform height along the transverse direction of the inter-bar liquid-pooling section. Therefore, the occurrence of the aforementioned stripe-form defects can be effectively prevented.

Herein, the transverse direction of the inter-bar liquid-pooling section can also be referred to as the direction in which the first side bar extends.

In the present invention, the coating liquid suction opening portion may be a continuous slit-form opening portion.

In the coating device described above, the liquid surface height of the coating liquid along the transverse direction of the inter-bar liquid-pooling section is particularly uniform. Thus, the occurrence of the aforementioned stripe-form defects can be particularly effectively prevented.

The present invention may further include a first side dam-form member, which is provided standing at the upstream side relative to the first side bar and forms a portion of a wall face of the first side coating liquid supply channel. The present invention may be a coating device which forms the air-liquid boundary surface at a position in the height direction which can be set by specifying a positional relationship in the height direction of a peak portion of the first side dam-form member in relation to the first side bar.

This coating device is an example in which the first side dam-form member is provided in the coating device described previously.

In the coating device described above, the liquid surface height of the air-liquid boundary surface is a liquid surface height at a vicinity of an opening portion of the communicating channel that opens at the inter-bar liquid-pooling section.

Hence, because the inter-bar liquid-pooling section is communicated with the first side coating liquid supply channel by the communicating channel, the liquid surface height of the air-liquid boundary surface is the same as a liquid surface height at the first side coating liquid supply channel.

Here, because a portion of the wall face of the first side coating liquid supply channel is formed by the first side dam-form member, the liquid surface height at the first side coating liquid supply channel is the height of the peak portion of the first side dam-form member.

Therefore, the liquid surface height of the air-liquid boundary surface is also the same as the height of the peak portion of the first side dam-form member.

Accordingly, in this coating device, the height of the liquid surface of the coating liquid at the air-liquid boundary surface can be set by setting the height of the peak portion of the first side dam-form member, and thus the liquid surface height of the air-liquid boundary surface can be set with ease.

A second aspect of the present invention is a coating method for coating a coating liquid on a surface of a belt body, which is conveyed in a certain direction, using a first side bar which extends along a transverse direction of a conveyance plane and a second side bar which extends in parallel with the first side bar at a downstream side of the first side bar, the method including the step of carrying out the coating while an inter-bar liquid-pooling section is formed between the first side bar and the second side bar.

According to the coating method described above, for the same reasons as described for the first aspect of the present invention, a uniform coated surface can be obtained without the occurrence of liquid interruption due to entrained air, even in a case in which the conveyance speed of the belt body is high.

The second aspect of the present invention may include the step of, during the coating of the coating liquid, forming an air-liquid boundary surface, which is a boundary surface between the coating liquid and air, at the inter-bar liquid-pooling section.

The coating method in this case is an example of carrying out coating of the coating liquid while forming the air-liquid boundary surface.

According to the coating method described above, the occurrence of stripe-form defects can be effectively prevented.

DESCRIPTION OF THE PREFERRED EMBODIMENTS

1. Embodiment 1

An example of a coating device of the present invention will be described below.

Figure 1:
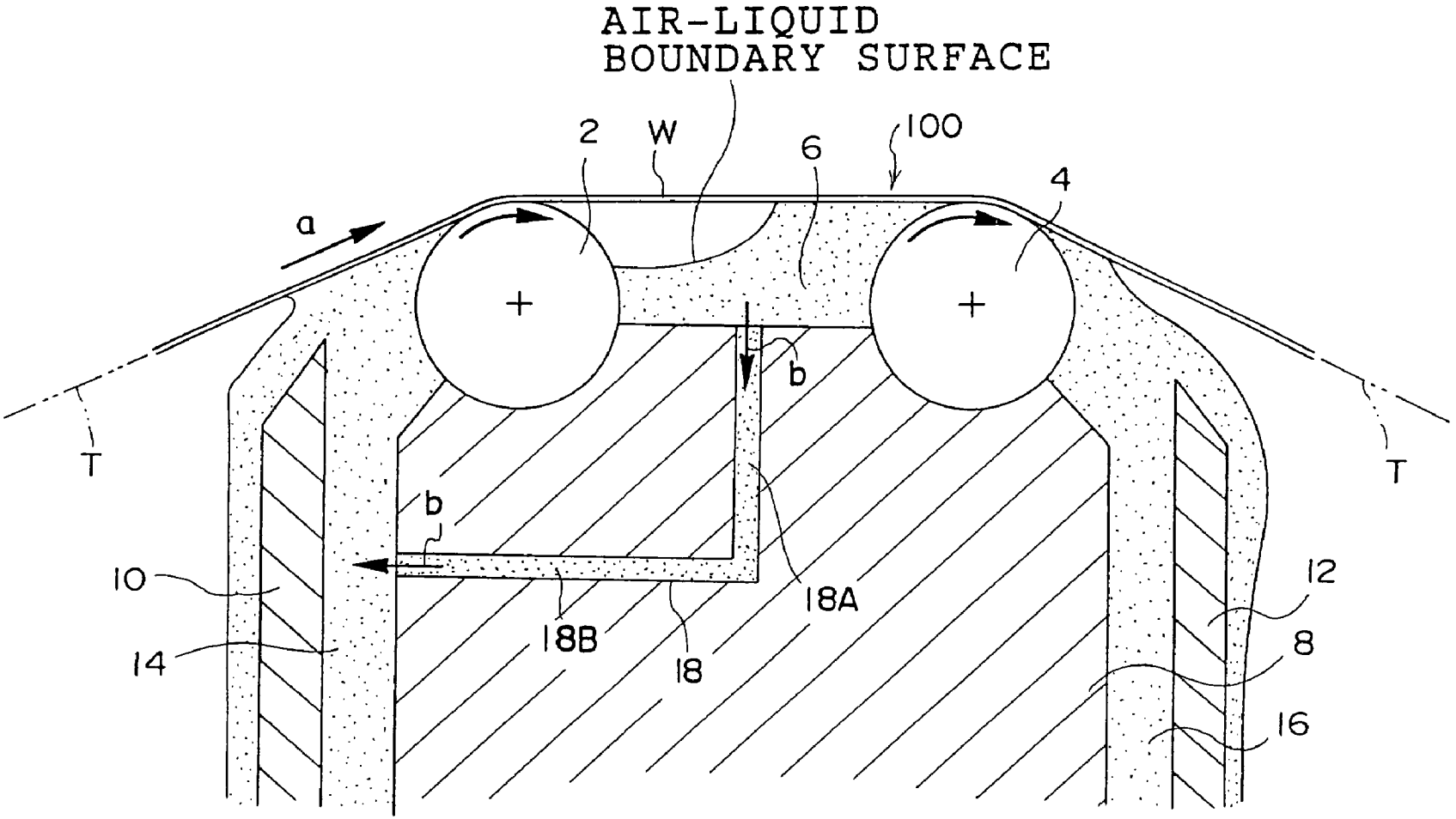
FIG. 1 is a sectional diagram showing structure of a coating device relating to an embodiment 1.

A coating device 100 relating to embodiment 1 is, as shown in FIG. 1, an example of a belt mode of the present invention. The coating device 100 is a coating device which coats a platemaking layer formation solution on a roughened surface of a support web W, which is conveyed along the direction shown by arrow a. The coating device 100 is equipped with a first side bar 2, a second side bar 4 and an inter-bar liquid-pooling section 6. The first side bar 2 extends in a direction orthogonal to the conveyance direction of the support web W at a conveyance plane which is a conveyance path of the belt body. The second side bar 4 is provided to be parallel with the first side bar 2, at a downstream side relative to the first side bar 2, and the second side bar 4 is at the same height as the first side bar 2. The inter-bar liquid-pooling section 6 is located between the first side bar 2 and the second side bar 4.

The first side bar 2 and the second side bar 4 both rotate in the same direction as the conveyance direction a, as viewed from a conveyance plane T, which is the conveyance path of the support web W.

A separation of the central axes of the first side bar 2 and the second side bar 4 can be suitably specified in accordance with composition and viscosity of the platemaking layer formation solution. Generally, the separation is set such that a duration from when the support web W passes over the first side bar 2 until the support web W passes over the second side bar 4 is 0.02 seconds or less.

The first side bar 2 and the second side bar 4 are supported from below by a pedestal 8. The inter-bar liquid-pooling section 6 is formed at an upper side of the pedestal 8.

A first side dam-form member (dam plate) 10, which is an example of a dam-form member of the present invention, is provided standing at an upstream side relative to the pedestal 8. A second side dam-form member 12 is provided standing at a downstream side relative to the pedestal 8. Both the first side dam-form member 10 and the second side dam-form member 12 are standingly provided to be parallel with the pedestal 8.

A first side supply flow channel 14 is formed between the first side dam-form member 10 and the pedestal 8. A second side supply flow channel 16 is formed between the second side dam-form member 12 and the pedestal 8. At the first side supply flow channel 14, the platemaking layer formation solution is supplied toward the first side bar 2 from below, and at the second side supply flow channel 16, the platemaking layer formation solution is supplied toward the second side bar 4 from below. The first side supply flow channel 14 and the second side supply flow channel 16 supply the platemaking layer formation solution respectively independently.

A connecting flow channel 18, which communicates the inter-bar liquid-pooling section 6 with the first side supply flow channel 14, is formed in the pedestal 8.

Figure 2:
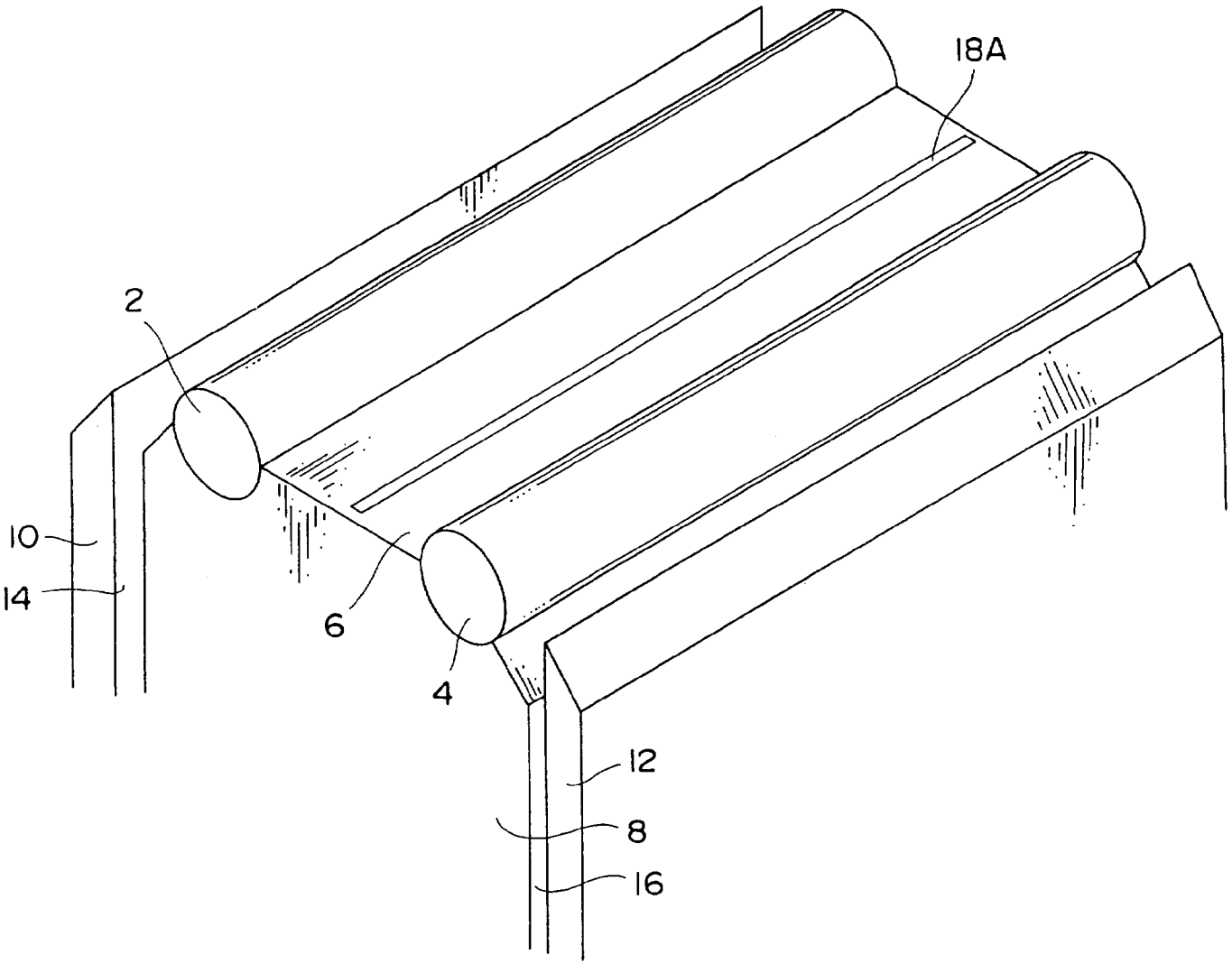
FIG. 2 is a perspective view, viewed from diagonally above, of the coating device shown in FIG. 1.

As shown in FIG. 2, the connecting flow channel 18 opens at the inter-bar liquid-pooling section 6 in a slit form which is continuous along the direction orthogonal to the conveyance direction a. The connecting flow channel 18 is provided with a vertical flow channel 18A and a horizontal flow channel 18B. The vertical flow channel 18A is a channel which extends downward in a vertical direction from the inter-bar liquid-pooling section 6. The horizontal flow channel 18B is provided in a horizontal direction toward the first side supply flow channel 14 from a lower end of the vertical flow channel 18A. The horizontal flow channel 18B may be formed in a divided slit form which is divided in a lateral direction into two or more divisions. The horizontal flow channel 18B may also be a flow channel which is formed by numerous small holes which are mutually parallel.

Figure 3:
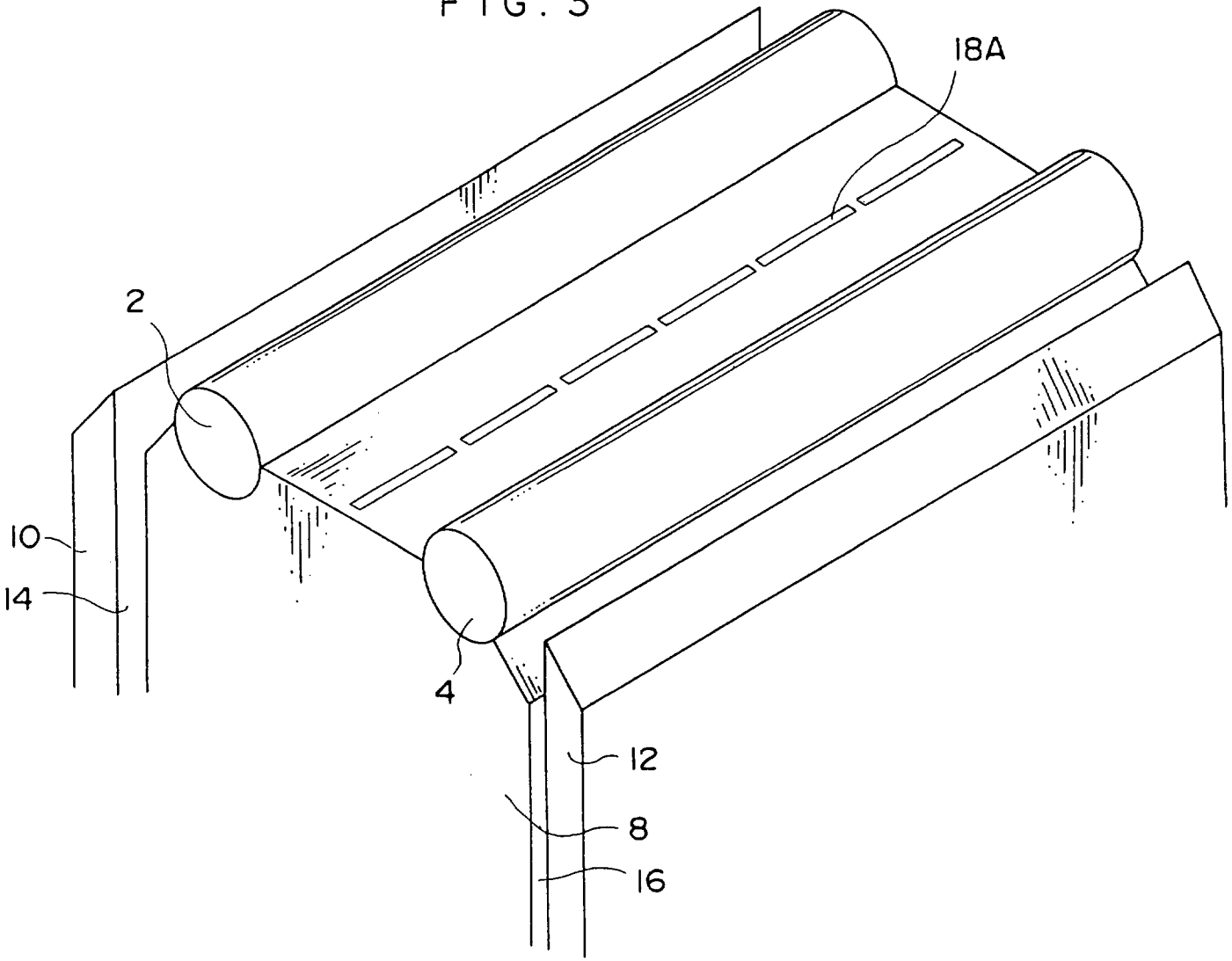
FIG. 3 is a perspective view showing an example of the coating device shown in FIG. 1, with a communicating channel with a form which differs from the form shown in FIG. 1.
Figure 4:
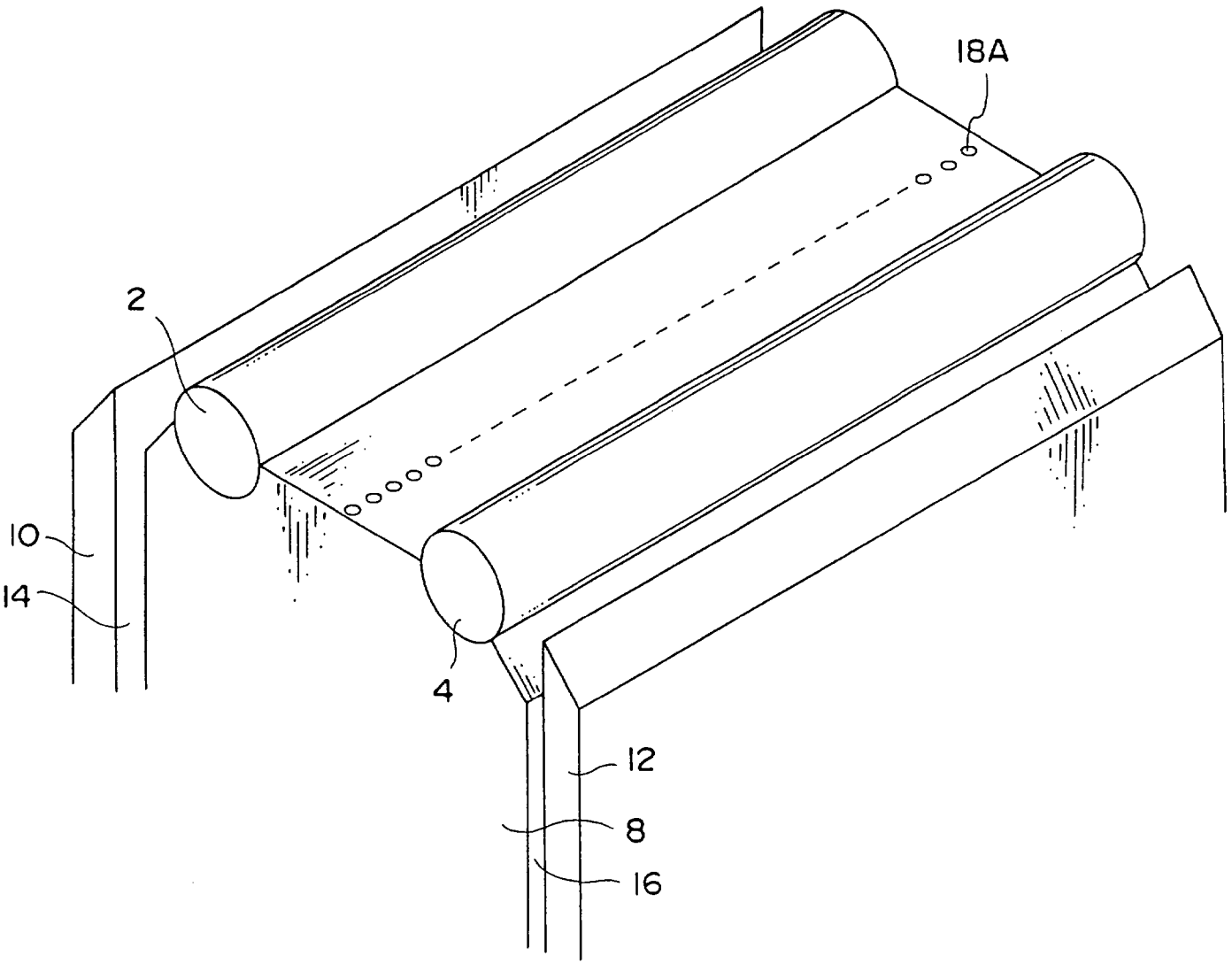
FIG. 4 is a perspective view showing an example of the coating device shown in FIG. 1, with a communicating channel with a form which differs from the forms shown in FIGS. 1 and 2.

The vertical flow channel 18A may open at the inter-bar liquid-pooling section 6 in a divided slit form as shown in FIG. 3. Further, as shown in FIG. 4, the vertical flow channel 18A may have small hole-form openings which are arranged in a row, or in two or more rows.

The first side dam-form member 10 is formed such that a peak portion thereof is lower than the conveyance plane T.

In this coating device 100, the platemaking layer formation solution supplied from the first side supply flow channel 14 is drawn up by the first side bar 2 and adheres to the roughened surface of the support web W.

A portion of the platemaking layer formation solution is conveyed downstream by the first side bar 2 and is accumulated in the inter-bar liquid-pooling section 6.

The support web W that has passed the first side bar 2 passes the inter-bar liquid-pooling section 6.

The support web W that has passed the inter-bar liquid-pooling section 6 then passes over the second side bar 4. At the second side bar 4, the platemaking layer formation solution that has been applied to the support web W is regulated to a predetermined coating amount.

At the second side bar 4, the platemaking layer formation solution is supplied from the second side supply flow channel 16. At the second side supply flow channel 16, the platemaking layer formation solution is supplied through a channel which is independent from the first side supply flow channel 14. Therefore, in any conditions, even if the supply flow amount at the first side supply flow channel 14 varies, the supply flow amount can be maintained to be stable at the second side supply flow channel 16.

Accordingly, because a particularly stable bead is formed at a periphery of the second side bar 4, the occurrence of defects due to instability of this bead is effectively prevented.

When the support web W passes the inter-bar liquid-pooling section 6, entrained air at the surface of the support web W is blocked by coating liquid that has accumulated in the inter-bar liquid-pooling section 6. As a result, defects such as liquid interruption in the coating film do not occur.

At the first side supply flow channel 14, because the platemaking layer formation solution circulates toward the upper side, there is a lowering of pressure at an opening portion at the first side supply flow channel 14 side of the horizontal flow channel 18B. Because the horizontal flow channel 18B communicates with the inter-bar liquid-pooling section 6 via the vertical flow channel 18A, the platemaking layer formation solution in the inter-bar liquid-pooling section 6 flows into the vertical flow channel 18A, and flows out to the first side supply flow channel 14 through the horizontal flow channel 18B. Thus, as shown by the arrows b in FIG. 1, a flow from the inter-bar liquid-pooling section 6 through the connecting flow channel 18 and as far as the first side supply flow channel 14 is generated.

Here, a height of the first side supply flow channel 14 is the same as a height of the first side dam-form member 10, and the height of the first side dam-form member 10 is lower than a height of the conveyance plane T, that is, a height of a peak portion of the first side bar 2. Accordingly, a liquid surface in the inter-bar liquid-pooling section 6 descends to the height of the first side dam-form member 10, and a space is formed between the liquid surface and the support web W. Thus, an air-liquid boundary surface is formed in the inter-bar liquid-pooling section 6.

Because the air-liquid boundary surface is formed in the inter-bar liquid-pooling section 6 in this fashion, a stable bead of the platemaking layer formation solution is formed at an upstream side of the second side bar 4. Therefore, even in a case in which the support web W is conveyed at high speed and a platemaking layer formation solution with high viscosity is supplied from the first side supply flow channel 14, a stable coated surface that is free of stripe-form defects such as ripple lines, blanking lines, constant pitch lines, black unevenness is obtained.

2. Embodiment 2

Figure 5:
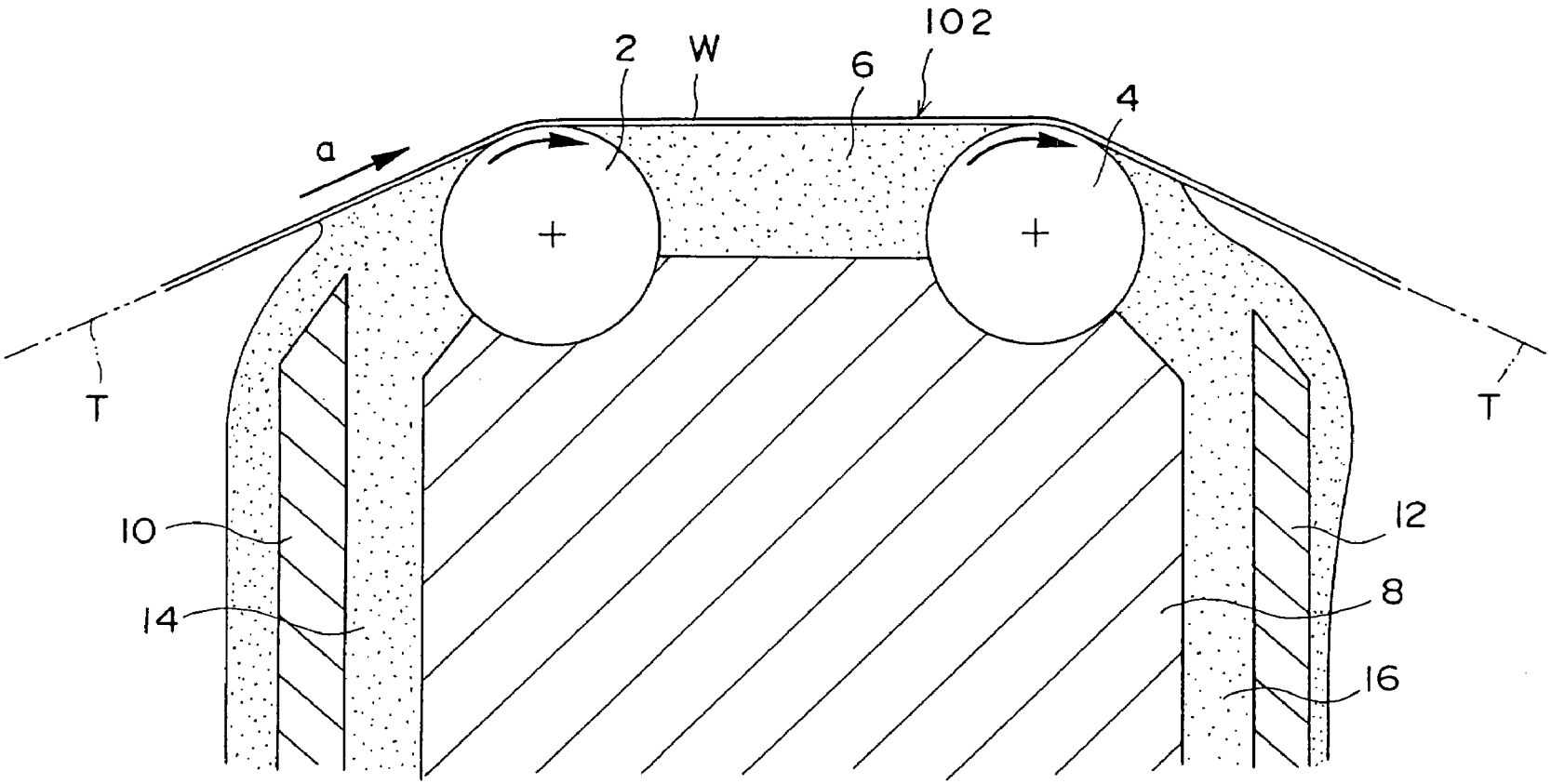
FIG. 5 is a sectional diagram showing structure of a coating device relating to an embodiment 2.

FIG. 5 shows another example of a coating device relating to the present invention. In FIG. 5, reference numerals that are the same as in FIGS. 1 and 2 indicate elements that are the same as the structural elements that are indicated by those reference numerals in FIGS. 1 and 2.

As shown in FIG. 5, a coating device 102 relating to embodiment 2 has the same structural elements as the coating device relating to embodiment 1, except that the connecting flow channel 18 is not formed in the pedestal 8.

In the coating device 102, the platemaking layer formation solution supplied from the first side supply flow channel 14 is drawn up by the first side bar 2 to the upper side thereof, and adheres to the roughened surface of the support web W.

The support web W that has passed the first side bar 2 passes the inter-bar liquid-pooling section 6.

The support web W that has passed the inter-bar liquid-pooling section 6 then passes over the second side bar 4. At the second side bar 4, the platemaking layer formation solution that has been applied to the support web W is regulated to a predetermined coating amount.

When the support web W passes the inter-bar liquid-pooling section 6, entrained air at the surface of the support web W is blocked by coating liquid that has accumulated in the inter-bar liquid-pooling section 6. Therefore, defects such as liquid interruption in the coating film do not occur.

Further, because there is no need to form a communicating flow channel in the pedestal 8, the structure can be simplified.

EXAMPLES

Examples 1 and 2, Reference Example 1

Using the coating device shown in FIG. 1, a photosensitive layer-forming solution was coated on a roughened surface of a support web. Coating conditions for the photosensitive layer-forming solution were as follows.

| | |
|---|---|
| a. Thickness of support web W | 0.3 mm |
| b. Running speed of support web W | 120 m/min |
| c. Separation of centers between the first side bar 2 and the second side bar 4 | 21 mm |
| d. Diameter of the first side bar 2 | 10 mm |
| e. Rotation speed of the first side bar 2 | 50 rpm |
| f. Width of downstream side slit | 5 mm |
| g. Surface tension of photosensitive layer-forming solution | 23 mN/m |

-continued

| | |
|---|---|
| h. Coating amount of photosensitive layer-forming solution at the first side supply flow channel 14 | 50 cc/$m^2$ |
| i. Coated amount of photosensitive layer-forming solution after passing the second side bar | 20 cc/$m^2$ |
| j. Viscosity of photosensitive layer-forming solution | 20 cp |

Results are shown in table 1. In table 1, "A" indicates a case in which the occurrence of black unevenness at the coated surface was not observed, and "B" represents a case in which the occurrence of black unevenness was observed to a slight extent.

TABLE 1

| | Communicating channel | Form of vertical channel | Occurrence of white stripes | Occurrence of black unevenness | Occurrence of excessive coating |
|---|---|---|---|---|---|
| Example 1 | Present | Divided slit form | 0/$m^2$ (600 $m^2$ inspected) | B | No |
| Example 2 | Present | Continuous slit form | 0/$m^2$ (600 $m^2$ inspected) | A | No |
| Reference Example 1 | Absent | — | 50/$m^2$ (50 $m^2$ inspected) | A | Yes |

As is shown in table 1, it can be seen that, when the platemaking layer formation solution was coated, stripe-form defects were generated at the coating device of Reference Example 1, in which an air-liquid boundary surface formation apparatus was not provided, whereas at the coating devices of Example 1 and Example 2, which were provided with air-liquid boundary surface formation apparatuses, the occurrence of stripe-form defects could be prevented.

Hence, it can be seen that providing an air-liquid boundary surface formation apparatus is effective for preventing the occurrence of stripe-form defects in a case in which a high-viscosity platemaking layer formation liquid is coated at high speed.

Note that, although the occurrence of stripe-form defects was observed with the coating device of Reference Example 1, it is thought that the occurrence of stripe-form defects might not be observed if the viscosity, surface tension of the photosensitive layer-forming solution were different.

Liquid channeling of the platemaking layer formation solution was not observed with the coating devices of any of Examples 1 and 2 and Reference Example 1.

Examples 3 and 4, Reference Example 2

A platemaking layer formation solution the same as that used in Example 1 was coated at a conveyance speed of 120 m/min. The separation of centers between the first side bar and the second side bar was varied in three steps: 20 mm, 40 mm and 50 mm. Results at these times are as shown in table 2.

TABLE 2

| | Example 3 | Example 4 | Reference Example 2 |
|---|---|---|---|
| Inter-bar separation | 20 mm | 40 mm | 50 mm |
| Inter-bar passage duration | 0.01 s | 0.02 s | 0.025 s |
| Occurrence of stripe-form defects | Not occurred | Not occurred | Occurred |

In table 2, the inter-bar separation represents the distance between the centers of the first side bar and the second side bar. The inter-bar passage duration represents a time duration from when the support web W passes above the first side bar until the support web W passes above the second side bar.

In Example 3 and Example 4, in which the inter-bar passage duration was 0.02 seconds or less, none of white striping, black unevenness and excessive coating occurred. In contrast, in Reference Example 2, in which the inter-bar passage duration exceeded 0.02 seconds, each of these stripe-form defects was observed.

Note that, even with the conditions represented in Reference Example 2, it is thought that the occurrence of the aforementioned stripe-form defects might not be observed if the surface tension and viscosity of the photosensitive layer-forming solution were different, the conveyance speed was higher.

As is explained above, according to the present invention, a coating device and coating method can be provided with which, even in a case in which a belt body is run at high speed and coating is carried out, defects such as film discontinuities in a coating film do not occur, and stable coating can be carried out.

What is claimed is:

1. A coating device for coating a coating liquid on a surface of a belt body which is conveyed in a certain direction, the coating device comprising:

a first side bar which extends along a transverse direction of a conveyance plane, which conveyance plane includes a conveyance path of the belt body;

a second side bar at a downstream side relative to the first side bar, which extends in parallel with the first side bar;

a first side coating liquid supply channel, which supplies the coating liquid at an upstream side at the first side bar;

an inter-bar liquid-pooling section located between the first side bar and the second side bar, which accumulates the coating liquid at a time of coating of the coating liquid; and a connecting channel which channels the coating liquid from the inter-bar liquid-pooling section to the first side coating liquid supply channel so as to lower the coating liquid in the inter-bar liquid-pooling section, wherein an air-liquid boundary surface is formed between the coating liquid and air, between the belt body and the inter-bar liquid-pooling section.

2. The coating device of claim 1, further comprising a second side coating liquid supply channel which supplies the coating liquid at a downstream side at the second side bar, wherein a supplied amount of the coating liquid at the second side coating liquid supply channel is controlled independently from a supplied amount of the coating liquid at the first side coating liquid supply channel.

3. The coating device of claim 1, wherein the first side bar and the second side bar are rotatable in a direction equal to a conveyance direction of the belt body.

4. The coating device of claim 3, wherein a separation of central axes of the first side bar and the second side bar is set in accordance with composition and viscosity of the coating liquid.

5. The coating device of claim 4, wherein the separation of the central axes of the first side bar and the second side bar is set such that a duration from a time at which the belt body passes the first side bar until a time at which the belt body passes the second side bar is not more than 0.02 seconds.

6. The coating device of claim 3, further comprising a pedestal for supporting the first side bar and the second side bar.

7. The coating device of claim 6, further comprising a first side dam plate at an upstream side of the pedestal and a second side dam plate at a downstream side of the pedestal, wherein the first side dam plate and the second side dam plate are disposed to be parallel with the pedestal.

8. The coating device of claim 7, wherein the first side coating liquid supply channel is formed between the first side dam plate and the pedestal.

9. The coating device of claim 1, further comprising a first side dam-form member provided standing at an upstream side relative to the first side bar, the first side dam-form member forming a portion of a wall face of wherein a peak portion of the first side dam-form member includes a height which is equal to or higher than a height of a bottom face of the inter-bar liquid-pooling section and which is lower than the conveyance plane.

10. The coating device of claim 1, wherein the connecting channel comprises a coating liquid suction opening portion which opens along the transverse direction of the inter-bar liquid-pooling section, across substantially the whole width of the inter-bar liquid-pooling section.

11. The coating device of claim 10, wherein the coating liquid suction opening portion comprises a continuous slit-form opening portion.

12. The coating device of claim 1, wherein the connecting channel comprises: a vertical channel which opens at the inter-bar liquid-pooling section along a direction which is orthogonal with respect to the conveyance direction of the belt body; and a horizontal channel which is provided in a horizontal direction from a lower end of the vertical channel toward the first side coating liquid supply channel.

13. The coating device of claim 12 wherein the vertical channel opens in the form of a slit.

14. The coating device of claim 12 wherein the horizontal channel comprises a slit form which is divided into at least two divisions in the transverse direction.

15. The coating device of claim 12 wherein the horizontal channel comprises numerous mutually parallel holes.

16. The coating device of claim 12 wherein the vertical channel comprises openings in the form of at least one row of holes.

17. A coating method for coating a coating liquid at a surface of a belt body; the method comprising:

conveying the belt body in a certain direction;

forming an inter-bar liquid-pooling section between a first side bar, which extends along a transverse direction of a conveyance plane, and a second side bar, which extends in parallel with the first side bar at a downstream side of the first side bar;

supplying the coating liquid to an upstream side of the first side bar;

supplying the coating liquid to a downstream side of the second side bar; and using the first side bar and the second side bar to coat the coating liquid at the surface.

18. The coating method of claim 17 further comprising the step of, during the coating of the coating liquid, forming an air-liquid boundary surface, which is a boundary surface between the coating liquid and air, at the inter-bar liquid-pooling section.

19. The coating method of claim 17 further comprising controlling the supplying of the coating liquid to an upstream side of the first side bar independently from the supplying of the coating liquid to a downstream side of the second side bar.

* * * * *